US012644614B2

(12) United States Patent
Liang et al.

(10) Patent No.: US 12,644,614 B2
(45) Date of Patent: Jun. 2, 2026

(54) HUMIDIFICATION ASSEMBLY AND HUMIDIFIER

(71) Applicant: GD MIDEA ENVIRONMENT APPLIANCES MFG CO., LTD., Zhongshan (CN)

(72) Inventors: Haohui Liang, Zhongshan (CN); Yong Yu, Zhongshan (CN); Yinan Liang, Zhongshan (CN); Yanlong Zhou, Zhongshan (CN)

(73) Assignee: GD MIDEA ENVIRONMENT APPLIANCES MFG CO., LTD., Zhongshan (CN)

( * ) Notice: Subject to any disclaimer, the term of this patent is extended or adjusted under 35 U.S.C. 154(b) by 326 days.

(21) Appl. No.: 18/382,698

(22) Filed: Oct. 23, 2023

(65) Prior Publication Data

US 2024/0219047 A1 Jul. 4, 2024

(30) Foreign Application Priority Data

Dec. 30, 2022 (CN) ..... 202223586820.2

(51) Int. Cl.

| | |
|---|---|
| ***F24F 6/00*** | (2006.01) |
| ***F24F 1/0284*** | (2019.01) |
| ***F24F 1/037*** | (2019.01) |
| ***F24F 6/04*** | (2006.01) |
| ***F24F 13/14*** | (2006.01) |
| ***F24F 13/20*** | (2006.01) |

(52) U.S. Cl.

CPC ..... *F24F 6/043* (2013.01); *F24F 1/0284* (2019.02); *F24F 1/037* (2019.02); *F24F 13/14* (2013.01); *F24F 13/20* (2013.01); *F24F 2006/008* (2013.01)

(58) Field of Classification Search

CPC ..... F24F 6/043; F24F 1/0284; F24F 1/037; F24F 13/14; F24F 13/20; F24F 2006/008; F24F 6/06; F24F 2006/065

USPC ..... 261/83

See application file for complete search history.

(56) References Cited

U.S. PATENT DOCUMENTS

2011/0048237 A1* 3/2011 Ahn ..... F24F 6/06 261/80
2018/0100667 A1* 4/2018 Komae ..... F24F 11/89

FOREIGN PATENT DOCUMENTS

| | | | |
|---|---|---|---|
| JP | S53143643 | U | 11/1978 |
| JP | 2009041796 | A | 2/2009 |
| JP | 2011047637 | A | 3/2011 |

OTHER PUBLICATIONS

Japan Patent Office (JPO) The Office Action For JP Application No. 2023-139221 Aug. 20, 2024 16 Pages (Translation Included ).

* cited by examiner

*Primary Examiner* — T. Bennett Mckenzie
(74) *Attorney, Agent, or Firm* — Anova Law Group, PLLC

(57) ABSTRACT

A humidification assembly includes a humidification member that is annular and has a mounting space formed in a middle part of the humidification member, a water storage member including a water storage tank, and a driver connected to the humidification member to drive the humidification member to rotate and partially enter into the water storage tank.

17 Claims, 17 Drawing Sheets

HUMIDIFICATION ASSEMBLY AND HUMIDIFIER

CROSS-REFERENCE TO RELATED APPLICATION

This application claims priority to Chinese Application No. 202223586820.2, filed Dec. 30, 2022, the entire content of which is incorporated herein by reference.

TECHNICAL FIELD

The present application relates to the field of air treatment equipment technology, in particular to a humidification assembly and a humidifier.

BACKGROUND

With the development of the economy and the improvement of living standards, people have higher and higher requirements for quality of life and health. Since the humidity of indoor air would more or less affect people's life and work, direct evaporation air humidifiers gradually enter people's life and work, and especially become an indispensable small household appliance for families in dry areas.

In related art, humidifiers adopt a humidification scheme using a water runner, which immerses a part of the water runner in water in a water tank to absorb the water in the water tank using water holes on the water runner through the rotation of the water runner along the circumference, and evaporates the water absorbed by the water runner from the water tank to achieve the humidification effect.

However, in the related art, since the water runner is a thin sheet structure, the water absorption capacity of the water runner is small, resulting in a small amount of humidification.

SUMMARY

The present application aims to address at least one of the problems in the related art. Therefore, the present application provides a humidification assembly, which effectively increases the humidification capacity.

The present application further provides a humidifier.

According to the present application, an embodiment provides a humidification assembly, including:

- a humidification member being annular and being constructed with a mounting space in a middle part of the humidification member;
- a water storage member being constructed with a water storage tank; and
- a driver being connected to the humidification member to drive the humidification member to rotate and make the humidification member partially enter into the water storage tank.

According to the humidification assembly of the present application, by designing the humidification member to be annular, when the driver drives the humidification member to rotate, the humidification member partially enters into the water storage tank of the water storage member, and the humidification assembly having an annular structure can absorb a large amount of water from the water storage tank, and thus the humidification capacity is increased.

According to an embodiment of the present application, the humidification assembly further includes:

- an air supplier being arranged in the mounting space, where an air inlet direction of the air supplier is along an axial direction of the humidification member, and an air outlet direction of the air supplier is along a radial direction of the humidification member.

According to an embodiment of the present application, the humidification assembly further includes:

- an air cover including an air outlet plate and an air inlet plate, where a shape of the air outlet plate matches the humidification member, the air outlet plate is fixed in the mounting space, the air outlet plate is constructed with an air supply port towards the humidification member, the air inlet plate is flush with an end of the humidification member or located outside the mounting space, and the air inlet plate is constructed with an air suction port; and
- the air supplier is fixed inside the air cover and used to guide an airflow from the air suction port to the air supply port.

According to an embodiment of the present application, the humidification member includes:

- a support frame, being dynamically coupled to the driver, and being annular; and
- a water absorber being fixed at the support frame, and being annular.

According to an embodiment of the present application, the support frame, includes:

- a frame body; and
- an end cover being connected to the frame body, where both the frame body and the end cover are annular; and
- the water absorber is arranged between the frame body and the end cover.

According to an embodiment of the present application, the driver includes a drive gear, both the frame body and the end cover are provided with a ring gear, and the ring gear of the frame body or the ring gear of the end cover is engaged with the drive gear.

According to an embodiment of the present application, the water absorber includes a notch having a first size, where a part of the water absorber enters into the water storage tank under the driving by the driver, the part of the water absorber has a second size; and the first size is equal to or larger than the second size.

According to an embodiment of the present application, a counterweight member is arranged a position of the notch, and the driver drives the counterweight member to enter into the water storage tank when the humidification member does not work.

According to an embodiment of the present application, the counterweight member includes:

- a plurality of counterweight plates being distributed along the circumference of the water absorber; and
- a connection member, being configured to connect the plurality of counterweight plates with each other.

According to an embodiment of the present application, the plurality of counterweight plates are provided with at least one of a groove or a protrusion; and/or the plurality of counterweight plates are curved plates.

According to an embodiment of the present application, the humidification assembly further includes:

- a support member, being arranged at the water storage member, where the support member includes a radial mate surface and an axial mate surface, and ends of the support frame are adapted to the radial mate surface and the axial mate surface.

According to the present application, an embodiment provides a humidifier, including a housing and any one of the humidification assemblies mentioned above, where the humidification assembly is arranged in the housing, the housing includes an air inlet and an air outlet, and both the air inlet and the air outlet are in fluid communication with the mounting space.

According to an embodiment of the present application, each enclosing plate of the housing includes the air outlet, and/or, the air outlet is provided with a swing blade, and the swing blade has an adjustable swing angle to be switchable between different opening angles and closing angles.

One or more solutions in the embodiments of the present application mentioned above have at least one of the following effects:

according to the humidification assembly of the present application, by designing the humidification member to be annular, when the driver drives the humidification member to rotate, the humidification member partially enters into the water storage tank of the water storage member, and the annular humidification assembly can absorb a large amount of water from the water storage tank, so that the humidification capacity is increased.

The additional aspects and advantages of the present application are partially given in the following description, and would become obvious from the following description, or would be understood through the practice of the present application.

BRIEF DESCRIPTION OF DRAWINGS

In order to clearly illustrate the solutions according to the present application or the related art, the accompanying drawings used in the description of the embodiments of the present application or the related art are briefly introduced below. It should be noted that the drawings in the following description are only part embodiments of the present application. For those of ordinary skill in the art, other drawings can also be obtained according to these drawings without creative efforts.

REFERENCE NUMERALS

Figure 1:
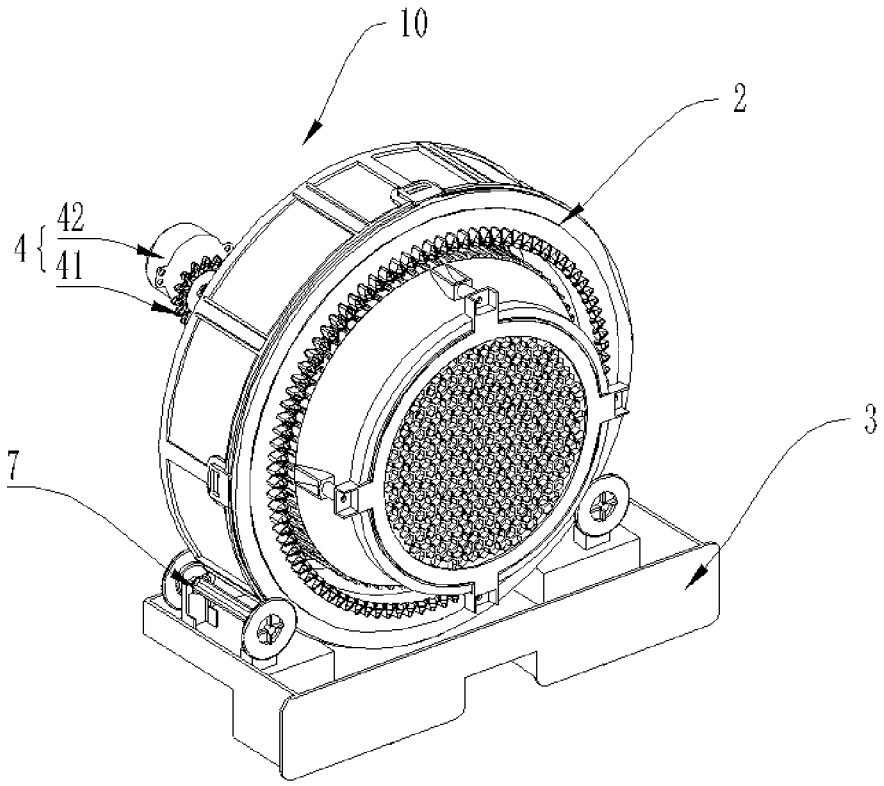
FIG. 1 is a schematic structural diagram of a humidification assembly according to an embodiment of the present application.

1, housing; 10, humidification assembly; 11, air inlet; 12, top air outlet; 13, left air outlet; 14, right air outlet; 15, top swing blade; 16, left swing blade; 17, right swing blade; 18, swing blade drive motor;

2, humidification member;

21, support frame; 211, frame body; 212, end cover; 213, ring gear; 214, first mate surface; 215, second mate surface;

22, water absorber; 221, notch; 23, counterweight member; 231, counterweight plate; 2311, groove; 232, connection member;

24, mounting space;

3, water storage member; 31. water level surface;

4, driver; 41, drive gear; 42, drive motor;

5, air supplier; 51, motor; 52, wind wheel;

6, air cover; 61, air outlet plate; 611, air supply port; 62, air inlet plate; 621, air suction port;

7, support member; 71, bearing; 72, limitation ring plate; 73, radial mate surface; 74, axial mate surface;

8, filter assembly.

DETAILED DESCRIPTION OF THE EMBODIMENTS

Embodiments of the present application are further described in detail below with reference to the drawings and embodiments. The following embodiments are intended to illustrate the present application, but are not intended to limit the scope of the present application.

In the description of the embodiments of the present application, it is to be noted that the orientation or positional relationships indicated by terms such as "center," "longitudinal," "lateral," "upper," "lower," "front," "rear," "left," "right," "vertical," "horizontal," "top," "bottom," "inside," "outside," etc. are based on the orientation or positional relationship shown in the drawings, and are merely for the convenience of describing the embodiments of the present application and simplifying the description, rather than indicating or implying that the device or component stated must have a particular orientation, be constructed and operated in a particular orientation, and thus these terms are not to be construed as limiting the embodiments of the present application. Moreover, the terms "first," "second," "third,"

and the like are used for descriptive purposes only and are not to be construed as indicating or implying relative importance.

In the description of the embodiments of the present application, it is to be noted that unless explicitly stated and defined otherwise, the terms "connected to," and "connected" shall be understood broadly, for example, the "connected" may be either fixedly connected or detachably connected, or can be integrated; the "connected" may be mechanically connected, or electrically connected; the "connected" may be directly connected, or indirectly connected through an intermediate medium. The specific meanings of the terms above in the embodiments of the present application can be understood by a person skilled in the art in accordance with specific conditions.

In the embodiments of this application, unless otherwise clearly stated and defined, the first feature being located "on" or "under" the second feature means that the first feature is in direct contact with the second feature or the first feature is in contact with the second feature by an intervening media. Also, the first feature being located "on," "above" and "on top of" the second feature may mean that the first feature is directly on or above the second feature, or it simply means that the level of the first feature is higher than the second feature. The first feature being located "under," "below" and "on bottom of" the second feature may mean that the first feature is directly under or below the second feature, or it simply means that the level of the first feature is lower than the second feature.

In the description of this specification, descriptions with reference to the terms "one embodiment," "some embodiments," "examples" "specific examples," or "some examples" etc. mean that specific features, structure, materials or characteristics described in conjunction with the embodiment or example are included in at least one embodiment or example of the embodiments of the present application. In this specification, the schematic expressions of the above terms do not necessarily refer to the same embodiment or example. Also, the described specific features, structures, materials or characteristics can be combined in any one or more embodiments or examples in a suitable manner. In addition, those skilled in the art may combine the different embodiments or examples described in this specification, as well as the features of the different embodiments or examples, without contradicting each other.

An embodiment of the present application provides a humidification assembly, and FIG. 1 illustrates a schematic structural diagram of the humidification assembly according to the embodiments of the present application. As shown in FIG. 1, the humidification assembly 10 includes a humidification member 2, a water storage member 3 and a driver 4, where the water storage member 3 is constructed with a water storage tank; the humidification member 2 is annular, and includes a mounting space 24 in the middle part of the humidification member 2; and the driver 4 is connected to the humidification member 2, so as to drive the humidification member 2 to rotate and make the humidification member 2 partially enter into the water storage tank.

The humidification member 2 is arranged at the water storage member 3, and the humidification member 2 is partially arranged inside the water storage tank of the water storage member 3, so that the humidification member 2 can enter into the water storage tank along the circumference to be immersed and absorb water continuously when the driver 4 drives the humidification member 2 to rotate.

By being arranged to be annular, the humidification member 2 has an axial length. When the humidification member 2 enters into the water storage tank, the humidification member 2 in the water storage tank has both an axial length and a radial length, so that the humidification member 2 has a larger absorbent area, and can absorb large amounts of water.

According to the humidification assembly of the present embodiment, by designing the humidification member 2 to be annular, when the driver 4 drives the humidification member 2 to rotate, the humidification member 2 partially enters into the water storage tank of the water storage member 3, and the humidification member 2 having the annular structure can absorb a large amount of water from the water storage tank, and thus the humidification capacity is increased, which meets the humidification requirements of large spaces.

Since the humidification member 2 is annular, the middle part of the humidification member 2 would not absorb water, thereby avoiding the waste in the water in the water storage tank.

Figure 2:
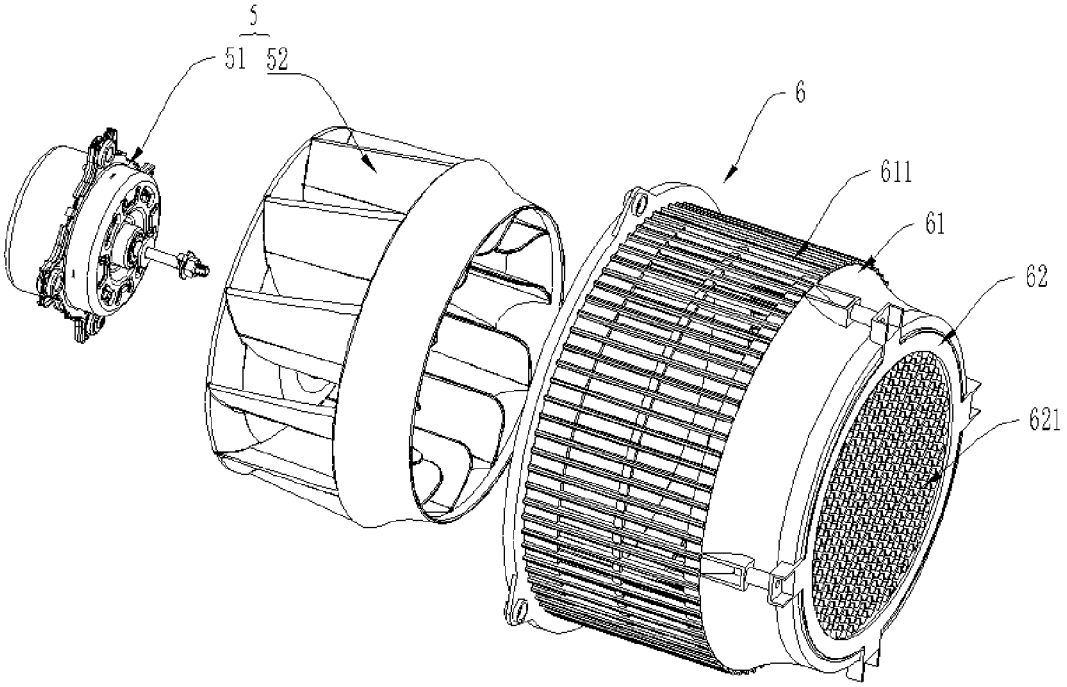
FIG. 2 is a schematic diagram showing an assembly relationship between an air supplier and an air cover according to an embodiment of the present application.

According to the embodiments of the present application, FIG. 2 illustrates a schematic diagram of an assembly relationship between an air supplier and an air cover according to an embodiment of the present application. As shown in FIGS. 1 and 2, the humidification assembly further includes: an air supplier 5 arranged in the mounting space 24, where an air inlet direction of the air supplier 5 is along an axial direction of the humidification member 2, and an air outlet direction of the air supplier 5 is along a radial direction of the humidification member 2.

The air supplier 5 is arranged in the mounting space 24 in the middle of the humidification member 2, plays air suction and air supply roles, and is used to suck an airflow (air) by an air suction mode and send the sucked airflow to the humidification member 2 by an air supply mode, so that an air inlet direction of the air supplier 5 can be along the axial direction of the humidification member 2, and an air outlet direction of the air supplier 5 can be along the radial direction of the humidification member 2.

In an embodiment of the present application, as shown in FIG. 2, the air supplier 5 can include a motor 51 and a wind wheel 52, where the wind wheel 52 is coaxially arranged in the humidification member 2, and the wind wheel 52 is coaxially connected to an output shaft of the motor 51.

According to the embodiments of the present application, as shown in FIGS. 1 and 2, the humidification assembly 10 further includes: an air cover 6, and the air cover 6 includes an air outlet plate 51 and an air inlet plate 62, where the shape of the air outlet plate 61 matches the humidification member 2, the air outlet plate 61 is fixed in the mounting space 24, the air outlet plate 61 is constructed with an air supply port 611 towards the humidification member 2, the air inlet plate 62 is flush with an end of the humidification member 2 or located outside the mounting space 24, and the air inlet plate 62 is constructed with an air suction port 621; and the air supplier 5 is fixed inside the wind cover 6 and used to guide an airflow from the air suction port 621 to the air supply port 611.

The air outlet plate 61 can be an annular structure, and the air inlet plate 62 can be in a circular structure. The air inlet plate 62 is arranged at an end of the air outlet plate 61, the air outlet plate 61 is coaxially arranged inside the humidification member 2, and the air supplier 5 is arranged inside the air cover 6.

The air outlet plate 61 is provided with a plurality of air supply ports 611 in the circumferential direction, and the air supply ports 611 face the humidification member 2; and the air inlet plate 62 is provided with air suction ports 621 in the radial direction.

The motor 51 drives the wind wheel 52 to rotate, then the wind wheel 52 sucks the airflow (air) entered through the air suction ports 621 of the air inlet plate 62 and blows the sucked airflow out through the air supply ports 611 of the air outlet plate 61, and the airflow is blown out to the humidification member 2 along the circumference to evaporate a large amount of water absorbed by the humidification member 2 from the water storage tank, thereby forming a humidification effect.

When the air cover 6 is arranged inside the humidification member 2, the position of the air inlet plate 62 of the air cover 6 can be flushed with the end of the humidification member 2. Since the air outlet plate 61 of the air cover 6 should be connected to the air inlet plate 62, an end of the air outlet plate 61 connected to the air inlet plate 62 is generally provided with a connecting part. In order to improve the stability of the connecting part, no air supply port 611 is provided at an annular end of the air outlet plate 61 at which the connecting part is located and the position of the air inlet plate 62 is flush with the end of the humidification member 2. Since the arrangement of the connecting part, the area in which the humidification member 2 and the connecting part match is not affected by the airflow, in result that the water absorbed by the humidification member 2 from the water storage tank cannot be completely evaporated, which further affect the humidification effect. Therefore, in the embodiments of the present application, the air inlet plate 62 can be located outside the mounting space 24, which is convenient for the connection of the air outlet plate 61 and the humidification member 2, the whole area in which the humidification member 2 and the connecting part match is provided with air outlets 611, and thus the humidification effect would not be affected.

Figure 3:
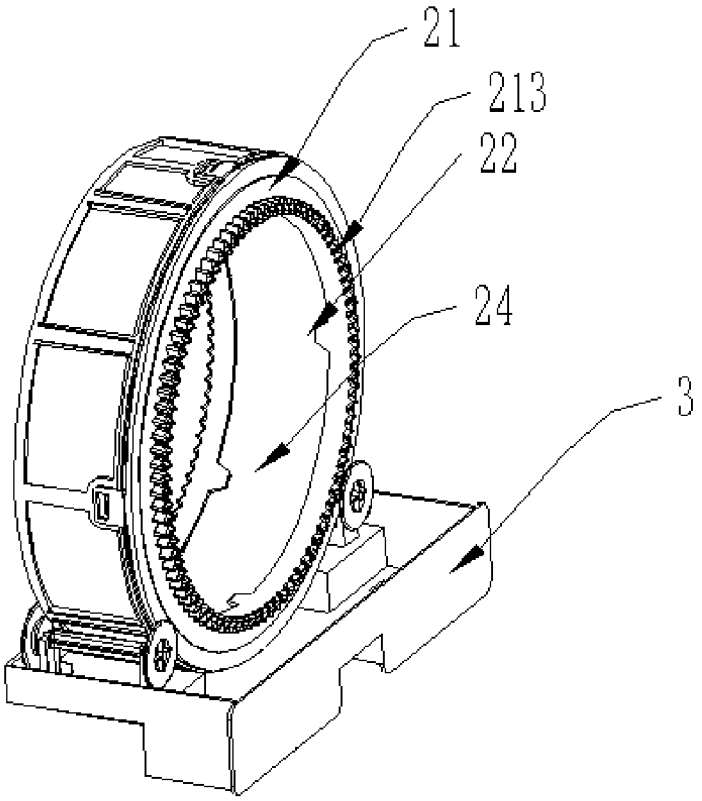
FIG. 3 is a schematic diagram showing an assembly relationship between a humidification assembly and a water storage member according to an embodiment of the present application.

In an embodiment of the present application, FIG. 3 illustrates a schematic diagram showing an assembly relationship between a humidification assembly and a water storage member according to an embodiment of the present application. As shown in FIG. 3, the humidification member 2 includes a support frame 21 and a water absorber 22; where the support frame 21 is dynamically coupled to the driver 4, and the support frame 21 is annular; and the water absorber 22 is fixed at the support frame 21, and the water absorber 22 is annular.

The water absorber 22 is fixed at the support frame 21, and the driver 4 drives the support frame 21 to rotate, and then the water absorber 22 on the support frame 21 rotates synchronously.

As shown in FIG. 3, both ends of the support frame 21 are provided with a ring gear 213, and as shown in FIG. 1, the driver 4 can include a drive motor 42 and a drive gear 41 arranged at an output shaft of the drive motor 42. The drive gears 41 meshes with the ring gear 213 on the support frame 21, so that the drive motor 42 drives the drive gears 41 to rotate, and the drive gear 41 drives the support frame 21 to rotate and thus the water absorber 22 on the support frame 21 rotates synchronously.

A mounting position of the driver 4 is usually fixed. If the ring gear 213 is only provided at one end of the support frame 21, when the support frame 21 is arranged at the water storage member 3, an end of the support frame 21 with which the ring gears 213 are provided is far away from the driver 4. As such, the support frame 21 cannot be engaged with the drive gear 41, and the support frame 21 should be reassembled to make the end of the support frame 21 provided with the ring gear 213 engaged with the drive gear 41, and thus the assembly efficiency of the humidification assembly 10 is affected. Therefore, in the embodiments of the present application, the ring gear 213 engaged with the drive gear 41 are provided at both ends of the support frame 21, and the ring gears 213 are engaged with the drive gear 41 no matter in which direction the support frame 21 is installed on the water storage member 3.

The ring gear 213 on the support frame 21 can be an inner ring gear arranged at the inner surface of the support frame 21, or an outer ring gear arranged at the outer surface of the support frame 21, only if the ring gear 213 is engaged with the drive gear 41.

Figure 4:
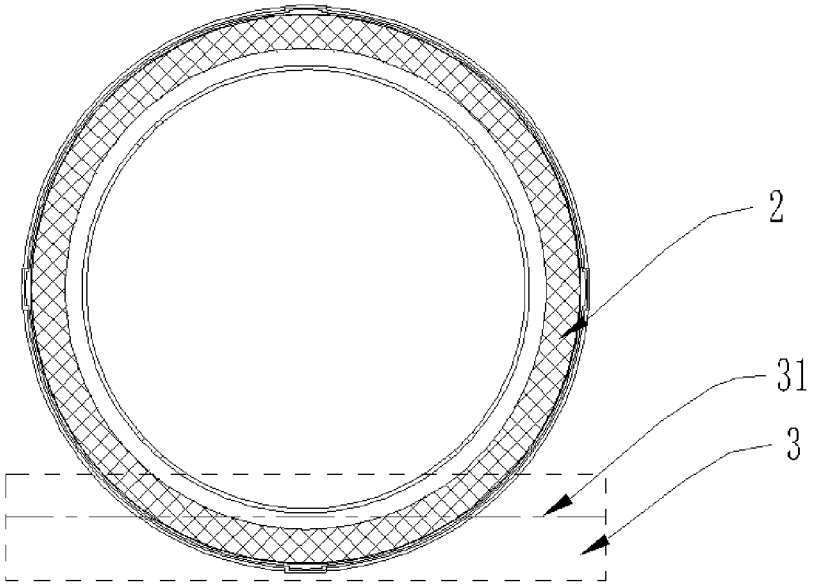
FIG. 4 is a first schematic structural diagram of a humidification member according to an embodiment of the present application.
Figure 5:
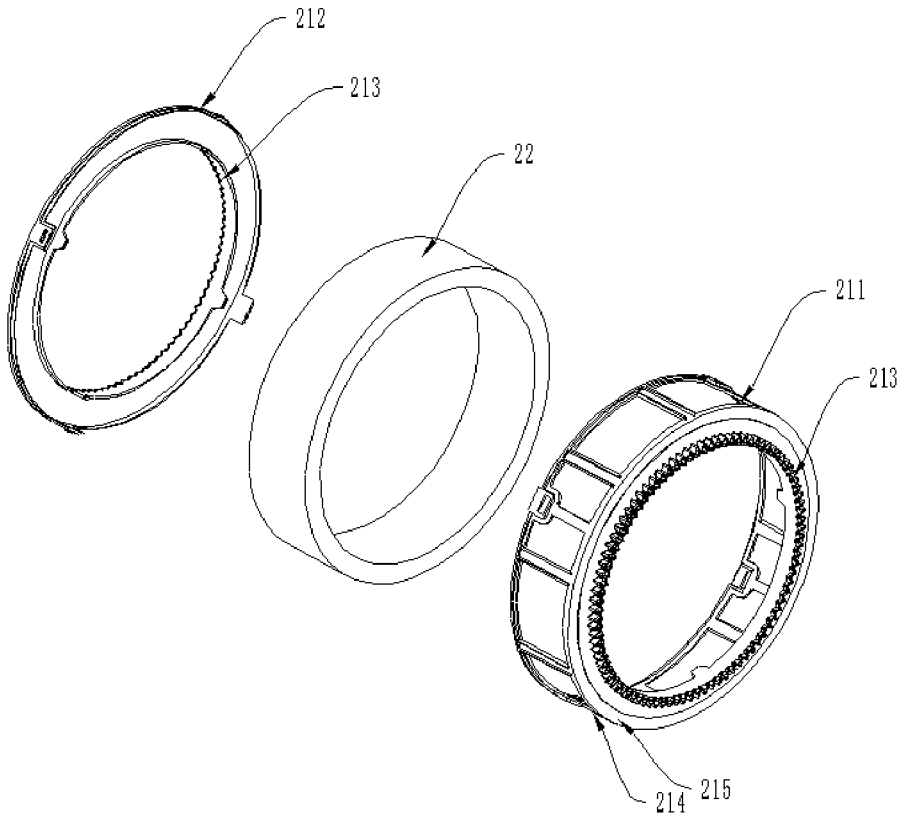
FIG. 5 is an schematic exploded diagram of the humidification member shown in FIG. 4.

FIG. 4 illustrates a first schematic structural diagram of a humidification member according to an embodiment of the present application; FIG. 5 illustrates an schematic exploded diagram of the humidification member shown in FIG. 4. As shown in FIGS. 4 and 5, the support frame 21 can include a frame body and an end cover connected to each other, the frame body 211 and the end cover 212 are annular, and the water absorber 22 is arranged between the frame body 211 and the end cover 212. Through the connection of the frame body 211 and the end cover 212, the water absorber 22 can be fixed between the frame body 211 and the end cover 212. The ring gears 213 on the frame body 211 and the end cover 212 may be internal ring gears.

As shown in FIG. 4, the upper plane of the water in the water storage tank is a water level surface 31, and the part of the water absorber 22 entering into the water storage tank below the water level surface 31 can absorb a large amount of water from the water storage tank.

Figure 6:
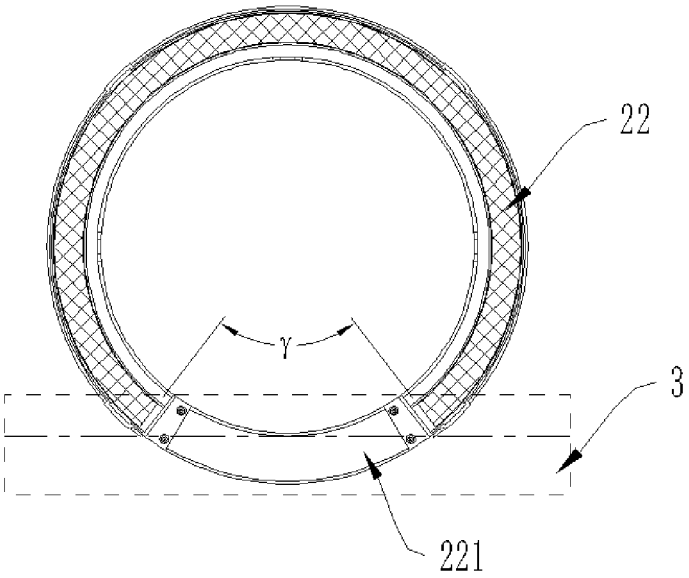
FIG. 6 is a second schematic structural diagram of a humidification member according to an embodiment of the present application.
Figure 7:
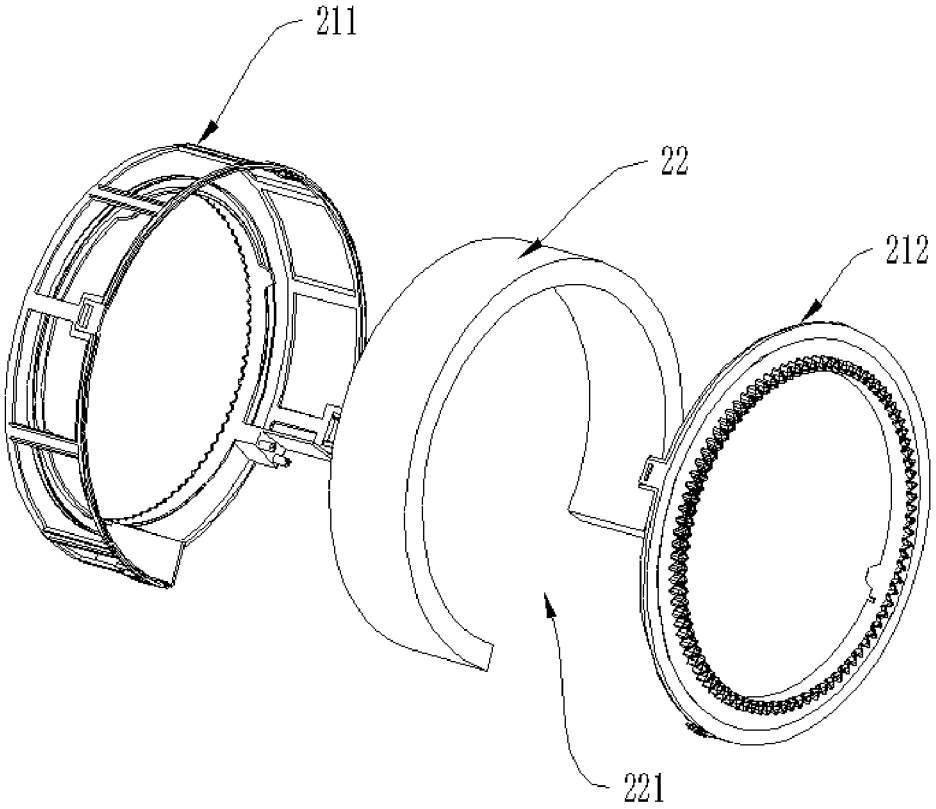
FIG. 7 is an schematic exploded diagram of the humidification member shown in FIG. 6.

In another embodiment of the present application, FIG. 6 illustrates a second schematic structural diagram of a humidification member according to an embodiment of the present application. FIG. 7 illustrates an schematic exploded diagram of the humidification member shown in FIG. 6. As shown in FIGS. 6 and 7, the water absorber 22 is provided with a notch 221, and the notch 221 has a first size. Under the driving by the driver 4, a part of the water absorber 22 enters into the water storage tank, and the part of the water absorber 22 has a second size, and the first size is equal to or larger than the second size.

The water absorber 22 is a whole annular structure. When the humidification assembly 10 does not work, the water absorber 22 (the part of the water absorber 22 below the water level surface 31 of the water storage tank) soaked in the water storage tank for a long time is prone to be smelly. Thus, the water absorber 22 should be disassembled and cleaned, which is usually not easy for the user, and the disassembly may cause damage to the humidification assembly 10. Therefore, the present embodiment of the present application optimizes the structure of the water absorber 22 in order to prevent the water absorber 22 from becoming smelly.

The water absorber 22 is provided with a notch 221. When the humidification assembly 10 does not work, the notch 221 of the water absorber 22 is placed in the water storage tank, and the rest of the water absorber 22 is placed outside the water storage tank, so that the water absorber 22 would not be continuously soaked in water, and the water absorber 22 is not easy to become smelly.

The notch 221 is formed to have a first size, and the first size may be a central angle γ relative to the notch 221. A part of the water absorber 22 entering into the water storage tank driven by the driver 4 has a second size, and the second size may be a central angle relative to the part of the water absorber 22 located in the water storage tank. The first size is equal to or larger than the second size, indicating that the water absorber 22 is located above the water level surface 31 of the water storage tank.

It should be noted that the size of the notch 221 of the water absorber 22 can be designed to be equal to the second size.

When the first size of the notch 221 of the water absorber 22 is equal to the second size, a micro-contact between the side of the notch 221 of the water absorber 22 and the water in the water storage tank exits. Therefore, the first size can be designed to be greater than the second size. However, the first size is not the greater the better. If the first size is too large, it would cause the notch 221 of the water absorber 22 to be overlarge, and thus the absorbable area of the water absorber 22 would become smaller, thereby affecting the humidification amount. Therefore, in the embodiments of the present application, the first size is designed slightly greater than the second size, that is, a slight notch between the surface of the notch 221 of the water absorber 22 and the water in the water storage tank exists.

According to the embodiments of the present application, a position of the water absorber 22 can be located by a position sensor, to guarantee that the notch 221 of the water absorber 22 is just in the water storage tank when the humidification assembly 10 does not work.

According to the humidification assembly provided by an embodiment of the present application, the water absorber 22 is provided with a notch 221. When the humidification assembly 10 does not work, the notch 221 of the water absorber 22 can be partially soaked in water of the water storage tank, and the rest of the water absorber 22 is placed outside the water storage tank, which can avoid the smelly problem caused by soaking the water absorber 22 in the water of the water storage tank.

Figure 8:
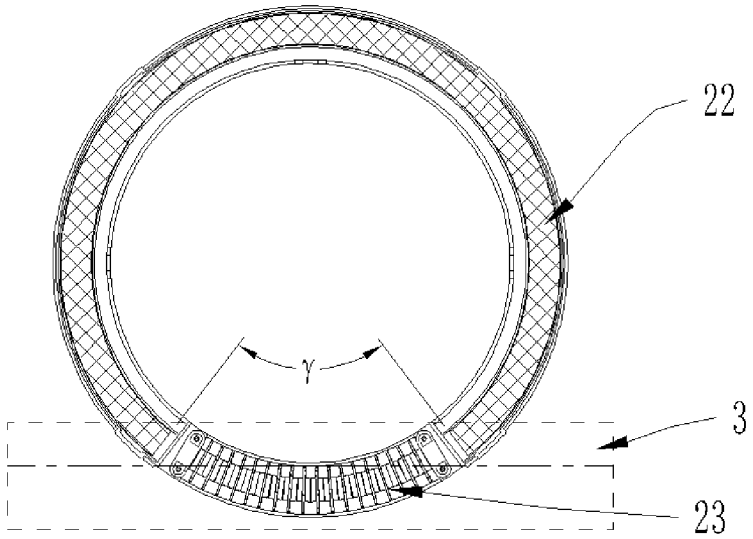
FIG. 8 is a third schematic structural diagram of a humidification member according to an embodiment of the present application.
Figure 9:
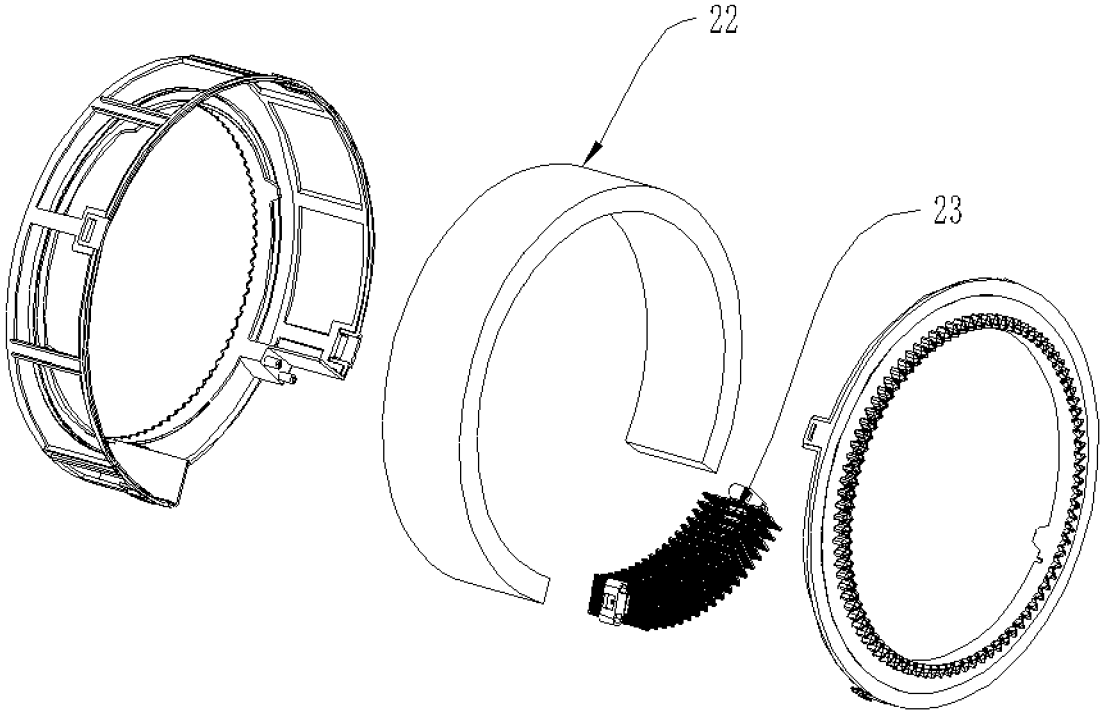
FIG. 9 is an schematic exploded diagram of the humidification member shown in FIG. 8.

In another embodiment of the present application, FIG. 8 illustrates a third schematic structural diagram of a humidification member according to an embodiment of the present application; FIG. 9 illustrates an schematic exploded diagram of the humidification member shown in FIG. 8. As shown in FIGS. 8 and 9, a counterweight member 23 is provided at the position of the notch 221, and the driver 4 drives the counterweight member 23 to enter into the water storage tank when the humidification member 2 does not work.

When the drive motor 42 drives the drive gear 41 to rotate, the drive gear 41 drives the support frame 21 to rotate, and then the water absorber 22 on the support frame 21 rotates synchronously. Since the water absorber 22 is provided with a notch 221, additional noise would be generated during the rotation of the water absorber 22. Therefore, the embodiments of the present application further optimize the structure of the water absorber 22 in order to avoid the noise generated during the rotation of the water absorber 22.

It should be noted that a counterweight member 23 is provided at the notch 221 of the water absorber 22 to fill the notch 221 of the water absorber 22; and the driver 4 drives the counterweight member 23 to enter into the water storage tank when the humidification member 2 does not work.

It should be noted that the counterweight member 23 can be made of non-absorbent materials, such as metal. The counterweight member 23 can be made of water-absorbing materials, such as plastic, and the water-absorbing materials should have the function of soaking water without stink.

When the counterweight member 23 is made of non-absorbent material, the counterweight member 23 mainly plays a role of filling the notch 221 and reducing noise. When the counterweight member 23 is made of a water-absorbing material, the counterweight member 23 not only plays a role of filling the notch 221 and reducing noise, but also plays a role of increasing the humidification amount.

According to the humidification assembly of an embodiment of the present application, a counterweight member 23 is arranged at the position of the notch 221 of the water absorber 22. When the humidification assembly 10 does not work, the counterweight member 23 at the position of the notch 221 of the water absorber 22 is soaked in water of the water storage tank, which can avoid the smelly problem caused by soaking the water absorber 22 in the water of the water storage tank while the counterweight member 23 can fill the notch 221 of the water-absorbing part 22 to play a role of reducing noise.

Figure 10:
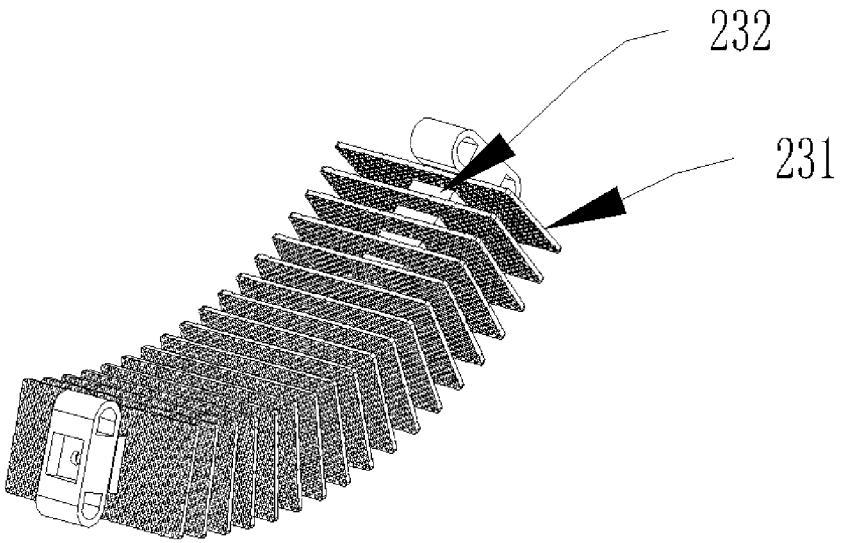
FIG. 10 is a schematic structural diagram of a counterweight member according to an embodiment of the present application.

According to the embodiments of the present application, FIG. 10 illustrates a schematic structural diagram of a counterweight member according to an embodiment of the present application. As shown in FIG. 10, the counterweight member 23 can include a plurality of counterweight plates 231 and connection members 232, the counterweight plates 231 are distributed along the circumference of the water absorber, and the connection members 232 is used to connect the plurality of counterweight plates with each other.

The plurality of counterweight plates 231 are distributed at intervals along the circumferential direction of the water absorber 22, and each adjacent two counterweight plates 231 are connected with each other by the connection member 232.

According to an embodiment of the present application, the plurality of counterweight plates 231 are provided with at least one of a groove 2311 or a protrusion; and/or the plurality of counterweight plates 231 are curved plates.

Figure 11:
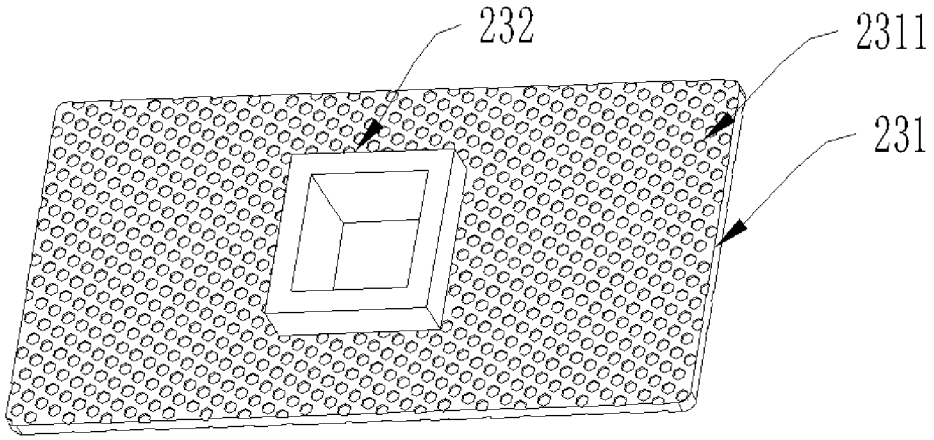
FIG. 11 is a schematic structural diagram of a counterweight plate according to an embodiment of the present application.

It should be noted that the weight plate 231 can be designed in the following ways, and the following manners can be combined with each other:

In the first manner, FIG. 11 illustrates a schematic structural diagram of a counterweight plate according to an embodiment of the present application. As shown in FIG. 11, grooves 2311 is arranged at the counterweight plate 231, and when the counterweight plate 231 of the water absorber 22 rotates to the water storage tank, the groove 2311 can absorb the water in the water storage tank.

It should be noted that a concave structure may also be arranged at the counterweight plate 231, and the concave structure has the same function as the groove structure.

In the second manner, protrusions are provided on each of the counterweight plate 231, and when the counterweight plate 231 of the water absorber 22 rotates to the water storage tank, accommodation spaces for absorbing water in the water storage tank are constructed between the plurality of protrusions.

In the third manner, the counterweight plate 231 can be designed as a curved plate, and when the counterweight plate 231 of the water absorber 22 rotates to the water storage tank, each counterweight plate 231 can construct an accommodating space for absorbing water in the water storage tank.

The counterweight plate 231 can absorb the water in the water storage tank, and an air duct is constructed between each adjacent two counterweight plates 231. The air duct can play the function of allowing the air to penetrate, so that the water absorbed by the counterweight plate 231 would be evaporated when the air blows through the counterweight plate 231 and thus the humidification capacity is increased.

According to the humidification assembly provided by an embodiment of the present application, by arranging grooves 2311, protrusions on the counterweight plates 231 and designing the plurality of counterweight plates 231 as curved plates, the counterweight plates 231 can absorb the water in the water storage tank, thereby increasing the water absorption capacity of the water absorber 22, and improving the humidification capacity.

In another embodiment of the present application, the water absorber 22 is a whole annular structure. In order to avoid the smelly problem caused by soaking the water absorber 22 in the water of the water storage tank for a long time when the humidification assembly 10 does not work, a sterilizer can be arranged in the water tank or a bactericidal substance can be added in the water storage tank. In an embodiment, the water absorber 22 may also be selected to be made of a water-absorbing and non-smelly material.

In another embodiment of the present application, a notch 221 is arranged at the water absorber 22, and a notch structure is further arranged at the support frame 21 corresponding to the notch 221 of the water absorber 22 as shown in FIG. 9. In addition, the support frame 21 cannot be provided with the adapted notch structure. When no notch structure arranged at the support frame 21 corresponding to the notch 221 of the water absorber 22, the humidification member 2 constructed by the support frame 21 and the water absorber 22 has strong stability and low noise during rotation, and no counterweight member can be provided at the notch 221 of the water absorber 22.

According to an embodiment of the present application, as shown in FIG. 1, the humidification assembly further includes: a support member 7. The support member 7 is arranged at the water storage member 3 and includes a radial mate surface 73 and an axial mate surface 74, and ends of the support frame 21 match a radial mate surface 73 and an axial mate surface 74.

The support member 7 is arranged at the water storage member 3, the support frame 21 is arranged at the support member 7, and the support frame 21 can rotate on the support member 7. In order to limit the position of the support frame 21, the radial mate surface 73 and the axial mate surface 74 are arranged at a position with which the end of the support frame 21 match the support member 7. The radial mate surface 73 is used for radially limiting the support frame 21 and the axial mate surface 74 is used for axially limiting the support frame 21.

Figure 12:
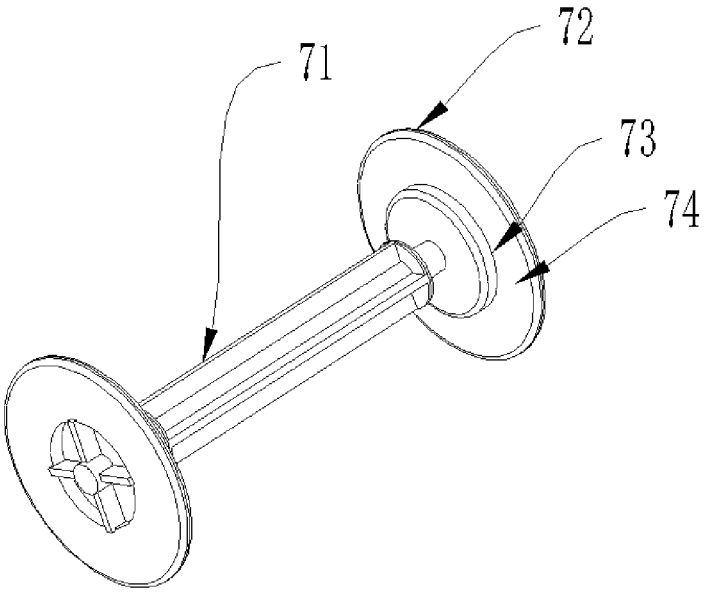
FIG. 12 is a schematic structural diagram of a support according to an embodiment of the present application.

FIG. 12 illustrates a schematic structural diagram of a support according to an embodiment of the present application. As shown in FIG. 1, the support member 7 may include two support members, the two support members are arranged at the water storage member 3 and located on both sides of the water storage tank. As shown in FIG. 12, each support member includes a bearing 71 and two limitation ring plates 72, and the bearing 71 is arranged rotatably on the water storage member 3 through a mounting bracket. Each limit ring plate 72 has a stepped structure, each of the small-diameter ends of the two limitation ring plates 72 is connected to each of two ends of the bearing 71. An outer circular surface of the small-diameter ends of the limitation ring plates 72 constructs a radial mate surface 73 and a surface connecting a large-diameter end and a small-diameter end of the limitation ring plate 72 constructs an axial mate surface 74. Ends of the support frame 21 are provided with a first mate surface 214 and a second mate surface 215, that is, the frame body 211 and the end cover 212 are provided with the first mate surface 214 and the second mate surface 215. The support frame 21 is placed on the two support members, and the support frame 21 is located between the two limitation ring plates 72 of the support member. The first mate surface 214 of the support frame 21 abuts against the radial mate surface 73 of the limitation ring plate 72, and the second mate surface 215 of the support frame 21 abuts against the axial mate surface 74 of the limitation ring plate 72, so that the support frame 21 is axially and radially limited and the humidification member 2 can rotate effectively on the support.

Figure 13:
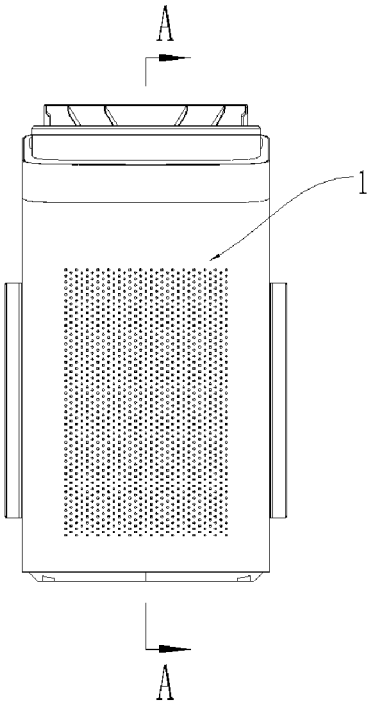
FIG. 13 is a first schematic structural diagram of a humidifier according to an embodiment of the present application.
Figure 14:
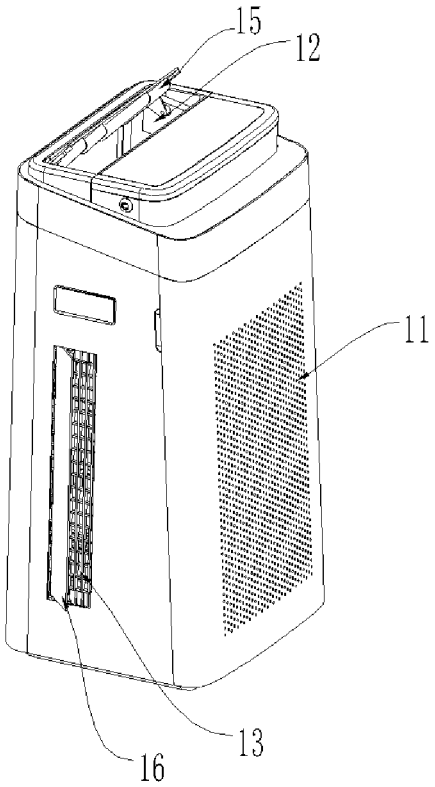
FIG. 14 is a second schematic structural diagram of a humidifier according to an embodiment of the present application.
Figure 15:
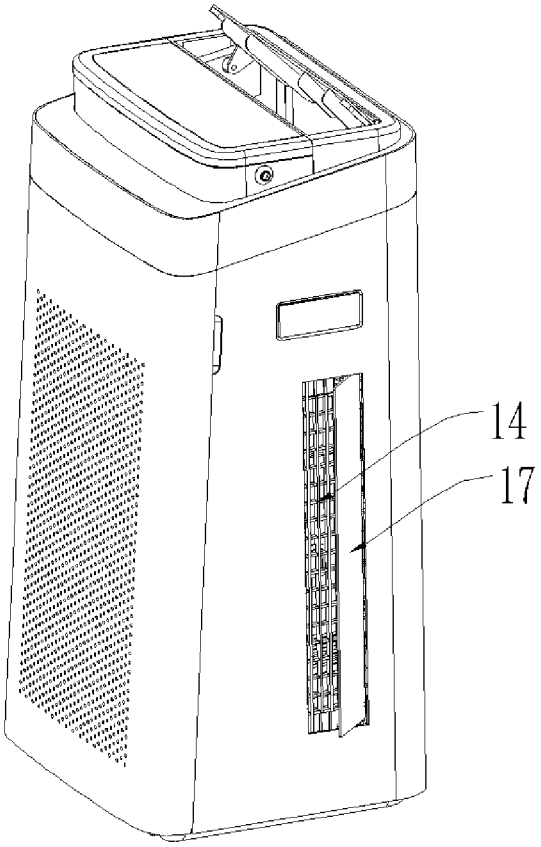
FIG. 15 is a third schematic structural diagram of a humidifier according to an embodiment of the present application.
Figure 16:
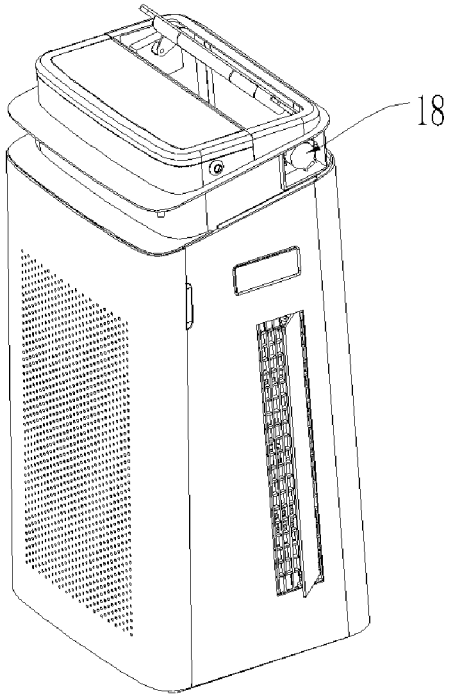
FIG. 16 is a fourth schematic structural diagram of a humidifier according to an embodiment of the present application.

According to a second aspect of the present application, an embodiment provides a humidifier. FIG. 13 illustrates a first schematic structural diagram of a humidifier according to an embodiment of the present application. FIG. 14 illustrates a second schematic structural diagram of a humidifier according to an embodiment of the present application. FIG. 15 illustrates a third schematic structural diagram of a humidifier according to an embodiment of the present application. FIG. 16 illustrates a fourth schematic structural diagram of a humidifier according to an embodiment of the present application. As shown in FIGS. 14 to 16 and FIGS. 13 to 16, the humidifier includes a housing 1 and one of the humidification assemblies 10 mentioned in the above embodiments. where the humidification assembly 10 is arranged in the housing 1, the housing 1 includes an air inlet 11 and an air outlet, and the air inlet 11 and the air outlet are in fluid communication with the mounting space 24.

The drive motor 42 of the humidification assembly 10 is arranged at the housing 1, and the motor 51 of the air supplier 5 of the humidification assembly 10 is also arranged at the housing 1.

According to an embodiment of the present application, each enclosing plate of the housing 1 includes the air outlet, and/or the air outlet is provided with a swing blade, and the swing blade has an adjustable swing angle to be switchable between different opening angles and closing angles.

The housing 1 may include a bottom enclosing plate, a top enclosing plate, and side enclosing plates arranged between the bottom enclosing plate and the top enclosing plate. The side enclosing plates include four enclosing plates, which are a left enclosing plate, a front enclosing plate, a right enclosing plate and a rear enclosing plate, and the left enclosing plate, the front enclosing plate, the right enclosing plate and the rear enclosing plate are connected in sequence.

It should be noted, at least one air inlet 11 is arranged at the housing 1. According to the embodiments of the present application, an air inlet 11 is arranged at the front enclosing plate, and an air outlet is arranged at the top enclosing plate, the left enclosing plate and the right enclosing plate. The air outlet on the top enclosing plate is a top air outlet 12, the air outlet on the left enclosing plate is a left air outlet 13, and the air outlet on the right enclosing plate is a right air outlet 14. The airflow enters through the air inlet 11, and can be blown out from the top air outlet 12, the left air outlet 13 and the right air outlet 14.

Swing blades may be arranged at the air outlets of the housing 1, and the air outlet angle of the air outlet may be adjusted by the swing blades. A top swing blade 15 is arranged at the top air outlet 12 of the top enclosing plate, and is used to adjust the air outlet angle of the top air outlet 12. A left swing blade 16 is arranged at the left air outlet 13 of the left enclosing plate, and is used to adjust the air outlet angle of left air outlet 13. A right swing blade 16 is arranged at the right air outlet 13 of the right enclosing plate, and is used to adjust the air outlet angle of right air outlet 13.

The swing blades can be driven by a swing blade drive, and the top swing blade 15, the left swing blade 16 and the right swing blade 17 can all be driven by a swing blade drive motor 18, and thus the humidifier is equipped with a swing blade drive motor for driving each swing blade (the top swing blade 15, the left swing blade 16 and the right swing blade 17) to rotate, so that the top swing blade 15, the left swing blade 16 and the right swing blade 17 work independently. The top swing blade 15, the left swing blade 16 and the right swing blade 17 can also be driven by one swing blade drive motor 18, and thus the humidifier is equipped with one swing blade drive motor 18 that drives all swing blades (the top swing blade 15, the left swing blade 16 and the right swing blade 17) to rotate, so that the swing blade drive motor 18 can make the top swing blade 15, the left swing blade 16 and the right swing blade 17 work synchronously. The top swing blade 15, the left swing blade 16 and can also make each right swing blade 17 work independently through a transmission assembly.

The air can be blown out through at least one of the top air outlet 12, the left air outlet 13 or the right air outlet 14 on the housing 1. The top air outlet 12, the left air outlet 13 and the right air outlet 14 on the housing 1 can be opened and closed based on the swing angle of the corresponding swing blade. When the swing blade is at a closed angle, the air outlet corresponding to the swing blade is a closed state. When the swing blade is at an open angle, the air outlet corresponding to the swing blade is in an open state, and the air outlet angle can be adjusted by rotating the swing blades.

At least one of the top air outlet 12, the left air outlet 13 or the right air outlet 14 on the housing 1 should be in an open state. The top air outlet 12 is selected to be in the open state, and the top swing blade 15 is at the opening angle.

Figure 17:
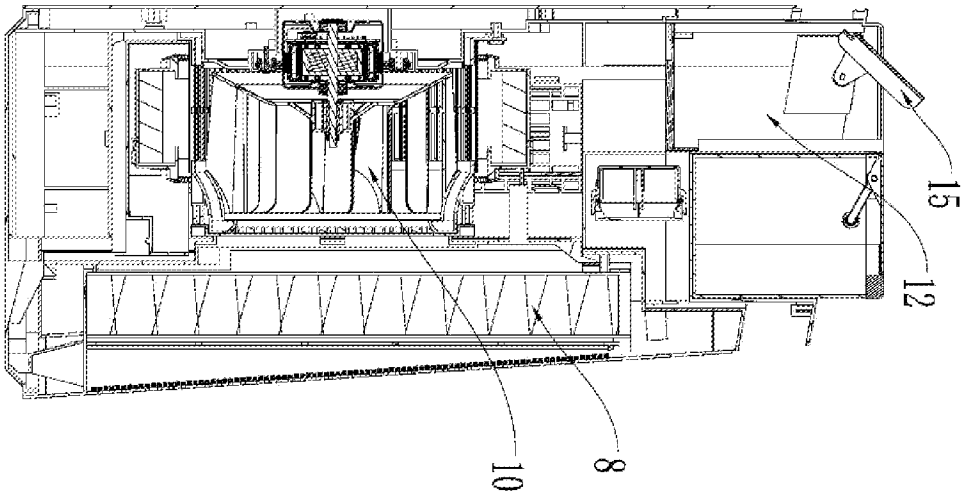
FIG. 17 is a sectional view along A-A direction of FIG. 13.

According to an embodiment of the present application, FIG. 17 is a sectional view along A-A direction of FIG. 13. As shown in FIGS. 13 and 17, the humidifier also includes a filter assembly 8 arranged inside the housing 1, and the filter assembly 8 plays a role of collecting dust, so that the humidifier not only has the function of humidifying, but also has the function of purifying the airflow.

The filter assembly 8 can be located on the front side of the humidification assembly 10, that is, in the air outlet direction of the air inlet 11 of the housing 1. The airflow passes through the air inlet 11 and then passes through the filter assembly 8 before entering into the humidification assembly 10. The filter assembly 8 is equipped with a dust collection filter with a planar structure, and the filter assembly 8 is used for filtering impurities (dust) in the airflow, and thus the humidifier has the effect of purifying the airflow.

The filter assembly 8 can be located on the rear side of the humidification assembly 10, that is, in the outer peripheral side of the humidification assembly 10. The airflow passes through the air inlet 11 and then passes through the filter assembly 10 before entering into the humidification assembly 8. The filter assembly 8 is equipped with an annular dust collection filter adapted with a humidification member 2, and the filter assembly 8 is used for filtering impurities (dust) in the airflow blown from the humidification member 2, and thus the humidifier has the effect of purifying the airflow.

The filter assembly 8 is located on the front side of the humidification assembly 10, and the filter assembly 8 is used for filtering impurities (dust) in the airflow, which can prevent impurities from entering into the humidification assembly 10, avoid both affecting the operation of the humidification assembly 10, and affect the humidification of the humidifier effect and service life.

According to an embodiment of the present application, a working process of the humidifier can be as follows: the water absorber 22 is partially placed in the water storage tank, and the water absorber 22 is driven to rotate by the drive motor 42 to absorb the water in the water storage tank. In addition, air enters through the air inlet 11 on the housing, passes through the filter assembly 8, is sucked by the air suction port 621, is blown out from the air supply port 611 along the circumferential direction, and is blown towards the water absorber 22, to make the water vapor in the water absorber 22 evaporate, and the water vapor are blow out from the top air outlet 12, the left air outlet 13 and the right air outlet 14, so as to achieve a humidification effect.

Finally, it should be noted that the above embodiments are only used to explain the solutions of the present application, and are not limited thereto; although the present application has been described in detail with reference to the foregoing embodiments, it should be understood by those skilled in the art that they can still modify the solutions documented in the foregoing embodiments and make equivalent replacements to a part of the features; these modifications and replacements do not make the essence of the corresponding solutions depart from the scope of the solutions of various embodiments of the present application.

What is claimed is:

1. A humidification assembly comprising:

a humidification member, the humidification member being annular and having a mounting space formed in a middle part of the humidification member;

a water storage member including a water storage tank;

a driver connected to the humidification member to drive the humidification member to rotate and partially enter into the water storage tank;

an air supplier arranged in the mounting space, an air inlet direction of the air supplier being along an axial direction of the humidification member, and an air outlet direction of the air supplier being along a radial direction of the humidification member; and an air cover including:

an air outlet plate having a shape matching the humidification member, the air outlet plate being fixed in the mounting space and including an air supply port towards the humidification member; and air inlet plate flush with an end of the humidification member or located outside the mounting space, the air inlet plate including an air suction port;

wherein the air supplier is fixed inside the air cover and configured to guide an airflow from the air suction port to the air supply port.

2. The humidification assembly of claim 1, wherein the humidification member includes:

a support frame dynamically coupled to the driver, and being annular; and a water absorber fixed at the support frame, and being annular.

3. The humidification assembly of claim 2, wherein:

the support frame includes a frame body and an end cover connected to the frame body, both the frame body and the end cover being annular; and the water absorber is arranged between the frame body and the end cover.

4. The humidification assembly of claim 3, wherein:

the driver includes a drive gear;

each of the frame body and the end cover is provided with a ring gear; and the ring gear of the frame body or the ring gear of the end cover is engaged with the drive gear.

5. The humidification assembly of claim 2, wherein:

the water absorber includes a notch having a first size; and the driver is configured to drive a part of the water absorber to enter into the water storage tank, the part of the water absorber has a second size smaller than or equal to the first size.

6. The humidification assembly of claim 5, further comprising:

a counterweight member arranged at a position of the notch;

wherein the driver is further configured to drive the counterweight member to enter into the water storage tank when the humidification member is not working.

7. The humidification assembly of claim 6, wherein the counterweight member includes:

a plurality of counterweight plates distributed along a circumference of the water absorber; and a connection member, configured to connect the plurality of counterweight plates with each other.

8. The humidification assembly of claim 7, wherein each of the plurality of counterweight plates includes at least one of a groove or a protrusion.

9. The humidification assembly of claim 7, wherein the plurality of counterweight plates are curved plates.

10. The humidification assembly of claim 7, wherein the plurality of counterweight plates are curved plates each including at least one of a groove or a protrusion.

11. The humidification assembly of claim 2, further comprising:

a support member arranged at the water storage member and including a radial mate surface and an axial mate surface;

wherein ends of the support frame are adapted to the radial mate surface and the axial mate surface of the support member.

12. A humidifier comprising:

a housing including an air inlet and an air outlet; and a humidification assembly arranged in the housing and including:

a humidification member, the humidification member being annular and having a mounting space formed in a middle part of the humidification member;

a water storage member including a water storage tank;

a driver connected to the humidification member to drive the humidification member to rotate and partially enter into the water storage tank;

an air supplier arranged in the mounting space, an air inlet direction of the air supplier being along an axial direction of the humidification member, and an air outlet direction of the air supplier being along a radial direction of the humidification member; and an air cover including:

an air outlet plate having a shape matching the humidification member, the air outlet plate being fixed in the mounting space and including an air supply port towards the humidification member; and air inlet plate flush with an end of the humidification member or located outside the mounting space, the air inlet plate including an air suction port;

wherein both the air inlet and the air outlet are in fluid communication with the mounting space, and the air supplier is fixed inside the air cover and configured to guide an airflow from the air suction port to the air supply port.

13. The humidifier of claim 12, wherein the housing includes an enclosing plate and the air outlet is provided at the enclosing plate.

14. The humidifier of claim 12, wherein the air outlet is provided with a swing blade, and the swing blade is switchable between one or more different opening angles and one or more closing angles.

15. The humidifier of claim 12, wherein:

the housing includes an enclosing plate and the air outlet is provided at the enclosing plate; and the air outlet is provided with a swing blade, and the swing blade is switchable between one or more different opening angles and one or more closing angles.

16. The humidifier of claim 12, wherein:

the air outlet is one of a plurality of air outlets of the housing; and the housing includes a plurality of enclosing plates each provided with one of the plurality of air outlets.

17. A humidification assembly comprising:

a humidification member, the humidification member being annular and having a mounting space formed in a middle part of the humidification member, and including:

a support frame dynamically coupled to the driver, and being annular; and a water absorber fixed at the support frame, and being annular, the water absorber including a notch having a first size;

a water storage member including a water storage tank;

a driver connected to the humidification member to drive the humidification member to rotate and partially enter into the water storage tank, the driver being configured to drive a part of the water absorber to enter into the water storage tank, and the part of the water absorber having a second size smaller than or equal to the first size; and a counterweight member arranged at a position of the notch, wherein the driver is further configured to drive the counterweight member to enter into the water storage tank when the humidification member is not working.

* * * * *